US007096851B2

(12) United States Patent
Matsuda et al.

(10) Patent No.: US 7,096,851 B2
(45) Date of Patent: Aug. 29, 2006

(54) THROTTLE DEVICE FOR MULTIPURPOSE ENGINE

(75) Inventors: Hayato Matsuda, Wako (JP); Tomoki Fukushima, Wako (JP); Shinichi Katsuragawa, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/874,181

(22) Filed: Jun. 24, 2004

(65) Prior Publication Data

US 2004/0261766 A1 Dec. 30, 2004

(30) Foreign Application Priority Data

Jun. 26, 2003 (JP) ..... 2003-183169
Jun. 26, 2003 (JP) ..... 2003-183170

(51) Int. Cl.
*F02D 11/10* (2006.01)

(52) U.S. Cl. ..... 123/399

(58) Field of Classification Search ..... 123/361, 123/396, 399
See application file for complete search history.

(56) References Cited

U.S. PATENT DOCUMENTS 4,210,110 A * 7/1980 Krebaum et al. ..... 123/396
4,860,708 A * 8/1989 Yamaguchi et al. ..... 123/399
4,951,772 A * 8/1990 Peter et al. ..... 123/361
5,131,362 A * 7/1992 Simon et al. ..... 123/396
5,131,364 A * 7/1992 Mann ..... 123/399
5,431,141 A * 7/1995 Kanazawa et al. ..... 123/399
5,868,114 A * 2/1999 Kamimura et al. ..... 123/399
5,983,858 A * 11/1999 Hashimoto et al. ..... 123/396
6,418,908 B1 * 7/2002 Wayama et al. ..... 123/399
6,672,564 B1 * 1/2004 Johann et al. ..... 251/305

FOREIGN PATENT DOCUMENTS

DE 004121890 A1 * 1/1993
JP 2001-263098 9/2001

* cited by examiner

*Primary Examiner*—T. M. Argenbright
(74) *Attorney, Agent, or Firm*—Westerman, Hattori, Daniels & Adrian, LLP.

(57) ABSTRACT

In a throttle device for a multipurpose internal combustion engine having a throttle valve, a throttle shaft connected to the throttle valve and an electric motor housed in a housing to move the throttle valve, both ends of a motor output shaft is configured to protrude from the housing in such a manner that the one end is connected to a power transmission mechanism, whilst the other end is inserted in a hollow boss formed in a fixing component of the motor, thereby ensuring no fluctuation to occur in the positional relation of the output shaft to the throttle shaft, while enabling to prevent friction from being generated in the power transmitting mechanism. In addition, a manual operating lever is provided to allow the engine to be easily started again even when the throttle valve is held nearly closed when the engine is stopped.

7 Claims, 6 Drawing Sheets

THROTTLE DEVICE FOR MULTIPURPOSE ENGINE

BACKGROUND OF THE INVENTION

1. Field of the Invention

The present invention relates to a throttle device for a multipurpose engine, and more particularly relates to a throttle device for a multipurpose engine that is configured such that a throttle valve opens and closes with the aid of an electric motor.

2. Description of the Related Art

In multipurpose engines (spark ignition internal combustion engines) used as drive sources for electrical generators, farming machinery, and various other applications, the opening of the throttle valve is usually adjusted by a mechanical governor made up of a weight and spring, and the rotational speed of the engine is thus controlled.

A technique has recently been proposed for precision control of the rotational speed of an engine using an electronically controlled throttle device (electronic governor) for opening and closing the throttle valve in this type of multipurpose engine with the aid of a stepping motor or other electric motor.

The electric motor for opening and closing the throttle valve is secured with a screw or the like to a fixing component provided near the throttle body. Positioning the electric motor with respect to the fixing component has generally been performed by inserting an extension formed in the electric motor housing into a member such as a hollow boss formed in the fixing component, or by forming a hollow portion in the fixing component that corresponds to the external shape (shape of the housing) of the electric motor and fitting the electric motor into the hollow portion, as taught in Japanese Laid-Open Patent Application No. 2001-263098, for example.

SUMMARY OF THE INVENTION

However, the above-mentioned technique has drawbacks whereby the positional relation of the output shaft to the throttle shaft varies and friction is generated in the gears or other power transmitting mechanism that connects them if there is a discrepancy (molding error) in the positional relation of the extension provided to the electric motor and the output shaft, or, in other words, in the center of gravity between the motor housing and the output shaft.

Aside from the above, when fuel is supplied to the multipurpose engine by a carburetor, the throttle must be opened fully or almost fully when the engine is started. Because of this, drawbacks occur when a carburetor is built into a throttle device such as is described in the above-mentioned Japanese patent application ('098), in that the electric motor is usually actuated after the engine is stopped to return the throttle valve to the fully open position, but if the throttle valve is held nearly closed by operating error or the like when the engine is stopped, it becomes difficult to start the engine again.

Accordingly, the present invention provides, in a first aspect, a throttle device for a multipurpose engine that is configured such that the output shaft of the electric motor is accurately positioned and there is no fluctuation in the positional relation of the output shaft to the throttle shaft, thereby preventing friction in the power transmitting mechanism that connects the aforementioned components.

The present invention provides, in a second aspect, a throttle device for a multipurpose engine adapted to open and close the throttle valve with the aid of an electric motor and to allow the engine to be easily started again even when the throttle valve is held nearly closed when the engine is stopped.

According to the first aspect of the present invention, there is provided a throttle device for a multipurpose internal combustion engine, comprising: a throttle valve disposed at an air intake passage of the engine; a throttle shaft connected to the throttle valve; an electric motor housed in a housing and connected to the throttle shaft to move the throttle valve, the electric motor having an output shaft whose ends protrude from the housing; a power transmitting mechanism connected to one end of the output shaft of the electric motor in such a manner that other end of the output shaft of the electric motor is received by a member formed in a fixing component of the electric motor; and a controller controlling operation of the electric motor to regulate an amount of air passing through the air intake passage.

According to the second aspect of the present invention, there is provided a throttle device for a multipurpose internal combustion engine, comprising: a throttle valve housed in a throttle body and disposed at an air intake passage of the engine; a throttle shaft connected to the throttle valve; an electric motor connected to the throttle shaft to move the throttle valve; a case connected to the throttle body and accommodating at least the throttle shaft in such a manner that one end of the throttle shaft protrudes from the case; a lever attached to the one end of the throttle shaft to be operable by an operator; and a controller controlling operation of the electric motor to regulate an amount of air passing through the air intake passage.

BRIEF DESCRIPTION OF THE DRAWINGS

The above and other objects and advantages of the invention will be more apparent from the following description and drawings, in which.

DESCRIPTION OF THE PREFERRED EMBODIMENTS

The throttle device for a multipurpose engine according to embodiments of the present invention will be described hereinafter with reference to the accompanying drawings.

Figure 1:
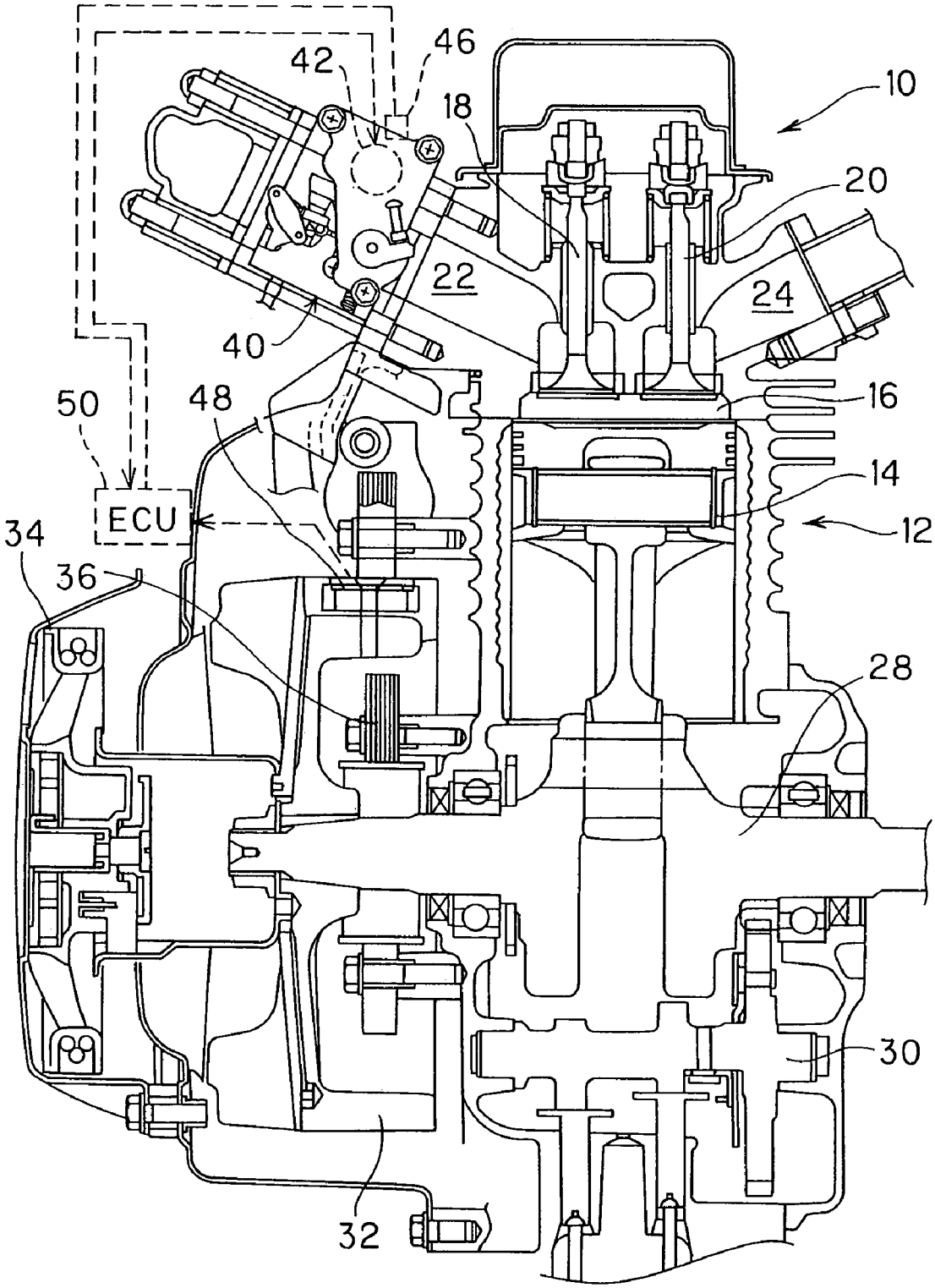
FIG. 1 is a schematic view showing the entire configuration of a throttle device for a multipurpose engine according to a first embodiment of the present invention.

FIG. 1 is a schematic view of the entire configuration of the throttle device for a multipurpose engine according to a first embodiment.

"10" in FIG. 1 indicates the multipurpose engine (hereinafter referred to as "engine"). The engine 10 is provided with one cylinder (cylinder) 12, and a piston 14 is contained therein so as to be able to reciprocate. A fuel combustion chamber 16 is formed in the space between the head of the piston 14 and the surface of the cylinder wall, and an intake valve 18 and an exhaust valve 20 are disposed in the cylinder wall which open and close between the fuel combustion chamber 16 and an air intake passage 22 or exhaust passage 24. The engine 10 specifically comprises a water-cooled four-cycle single cylinder OHV-type internal combustion engine that is provided with a volume displacement of 196 cc.

The piston 14 is connected to a crankshaft 28, and the crankshaft 28 is connected to a camshaft 30 via a gear. A flywheel 32 is attached to the crankshaft 28, and a recoil starter 34 for manually starting the engine 10 is also attached at the leading end of the flywheel 32. A generating coil (alternator) 36 is disposed on the inside of the flywheel 32 and generates an alternating electrical current. The alternating current generated by the generating coil 36 is converted to a direct current via a processing circuit (not shown), and is then supplied as the source of operating power to ECU (Electronic Control Unit), motor driver, ignition circuit (not shown), and other components described hereinafter.

A throttle body 40 is also disposed upstream from the intake passage 22. Although not pictured in FIG. 1, a throttle valve is housed in the throttle body 40 and is connected to the electric motor (stepping motor) 42 via the throttle shaft and power transmitting mechanism described hereinafter. A carburetor assembly is also provided to the throttle body 40 upstream from the throttle valve. The carburetor assembly is connected to the fuel tank and injects gasoline fuel into air drawn in according to the opening of a throttle valve to generate a fuel-air mixture. The fuel-air mixture thus generated is drawn in to the fuel combustion chamber 16 of the cylinder 12 through the intake passage 22 and intake valve 18.

A throttle-position sensor 46 is disposed near the electric motor 42 and outputs a signal indicative of the opening or position of θTH (hereinafter referred to as "throttle opening") of the throttle valve. A crank angle sensor 48 made up of an electromagnetic pickup is also disposed in the vicinity of the flywheel 32 and outputs a pulse signal at prescribed crank angle increments.

The ECU (controller; now assigned with reference numeral 50) is disposed near the engine 10. The ECU 50 is made up of a microcomputer and is provided with a CPU, ROM, RAM, and counter.

The outputs of the aforementioned throttle-position sensor 46 and crank angle sensor 48 are inputted into the ECU 50. The ECU 50 counts the output pulses of the crank angle sensor 48 and detects (computes) the engine speed NE.

The ECU 50 computes the amount of current to be issued to the electric motor 42 such that the detected engine speed NE becomes equal to a desired engine speed NED, based on the detected engine speed NE and the throttle opening θTH, and outputs the computed current to be supplied to the electric motor 42 to control the actuation of the electric motor 42.

Thus, in the present embodiment, the throttle valve is opened and closed and the engine speed NE is controlled by means of the electronically controlled throttle device (electronic governor) made up of the throttle body 40, ECU 50, various sensors, and other components.

Figure 2:
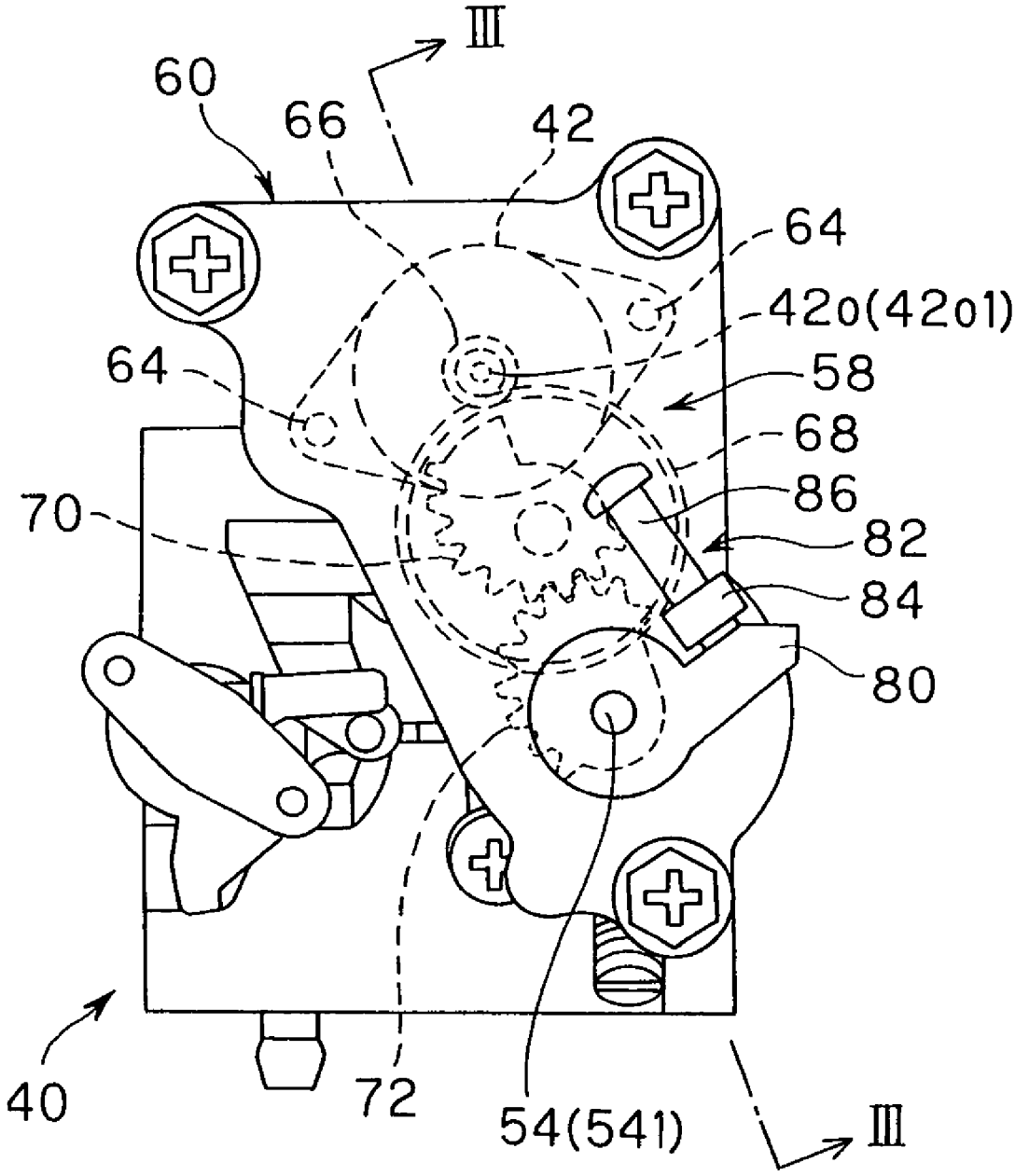
FIG. 2 is a plan view showing a throttle body of the throttle device illustrated in FIG. 1.
Figure 3:
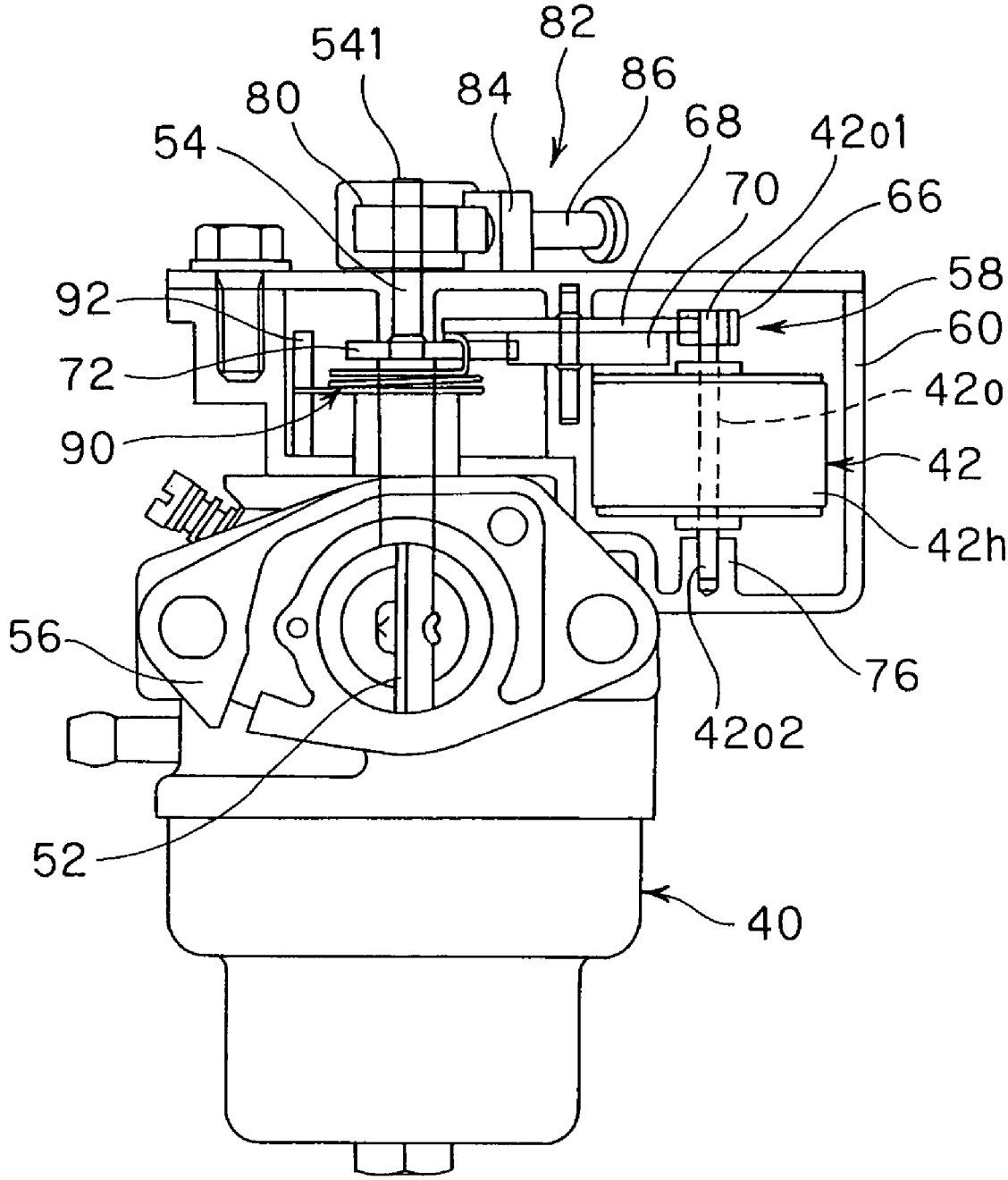
FIG. 3 is a cross-sectional view taken along line III—III of FIG. 2.

The throttle device for a multipurpose engine according to the present embodiment will be further described with reference to FIG. 2 and subsequent drawings. FIG. 2 is a plan view showing the throttle body 40 of the throttle device. FIG. 3 is a cross-sectional view taken along line III—III.

As illustrated in FIG. 3, the throttle valve (now assigned with reference numeral 52) is disposed partway along the air intake passage of the throttle body 40. The throttle valve 52 is supported by the throttle shaft 54. Also, the aforementioned carburetor assembly 56 is mounted upstream from the throttle valve 52 in the air intake passage of the throttle body 40.

Furthermore, as shown in FIGS. 2 and 3, a unit case 60 for housing the electric motor 42, a power transmitting mechanism 58 (speed-reduction-gear mechanism) made up of four gears, described hereinafter, and part of the throttle shaft 54 is integrally provided to the throttle body 40. The electric motor 42 is fastened to the unit case 60 by two screws 64, and the output shaft **42*o* thereof is connected to the throttle shaft 54 via the power transmitting mechanism 58**.

Specifically, a first gear 66 is attached to one end **42*o*1 of the output shaft of the electric motor 42, and the first gear 66 is engaged with a second gear 68 that is rotatably supported in the unit case 60. A third gear 70 is attached to the same shaft above the second gear 68, and the third gear 70 is engaged with a fourth gear 72 attached to the throttle shaft 54. The output of the electric motor 42 is thereby transmitted to the throttle shaft 54 while being reduced in speed by the gear ratios of the gears, and the throttle valve 52** is opened and closed.

The third gear 70 and fourth gear 72 are eccentric gears, as is clearly shown in FIG. 2. More specifically, the third gear 70 and fourth gear 72 are set such that the angle of rotation of the fourth gear 72 with respect to the angle of rotation of the third gear 70 is reduced (the speed reduction ratio increases) as the throttle opening θTH is reduced. This arrangement takes into consideration the fact that the pressure difference between upstream and downstream of the throttle valve 52 is reduced as the throttle opening θTH becomes larger, and ultimately becomes saturated (specifically, the variation in the amount of intake air passing through the throttle valve 52 widens when the throttle opening θTH is small). By performing the setting described above, it becomes possible to finely adjust the opening when the throttle opening θTH is small and to adjust the opening at a high opening and closing speed when the throttle opening θTH is large, and the desired engine speed can be followed with good precision and response.

As mentioned in the description of the background art, there is a danger of friction being generated in the power transmitting mechanism 58 that links the output shaft **42*o* of the electric motor 42 with the throttle shaft 54** if there is fluctuation in the positional relationship between these components.

Therefore, in the present embodiment, a configuration is adopted whereby both ends of the output shaft **42*o* of the electric motor 42 are caused to protrude from the housing 42*h* of the electric motor 42, with one end 42*o*1 connected to the throttle shaft 54 via the power transmitting mechanism 58 as previously described and the other end 42*o*2 inserted into a hollow boss (member) 76 (illustrated in FIG. 3) formed in the unit case 60 as a fixing component for the electric motor 42. Specifically, it is arranged such that the power transmitting mechanism 58 is connected to the one end 42*o*1 of the output shaft 42*o* of the electric motor 42 in such a manner that the other end 42*o*2 of the output shaft of the electric motor is received by the hollowed boss (member) formed in the fixing component (unit case 60) of the electric motor. Thus, a configuration is adopted whereby the positioning of the electric motor 42 with respect to the unit case 60 is accomplished by inserting the other end 42*o*2 of the output shaft into the boss 76 formed in the unit case 60**.

By adopting this configuration, even when there is a discrepancy (molding error) in the center of gravity of the output shaft **42*o* and the housing 42*h*, the positioning of the electric motor 42 is performed by the output shaft 42***o* rather than the housing 42*h*, so the output shaft 42*o* can be accurately placed in the desired position. Consequently, no fluctuation occurs in the positional relationship between the output shaft 42*o* and the throttle shaft 54, and friction can thereby be prevented from developing in the power transmitting mechanism 58 that links these components.

The onboard electric motor 42 can also be made smaller than conventionally, because the drive speed of the electric motor 42 can be increased and loss of transmission torque reduced by virtue of the ability to prevent friction from developing in the power transmission mechanism 58. Furthermore, because the output shaft of the electric motor 42 is usually of a smaller diameter than the housing 42*h*, as well as the positioning extension formed by a conventional technique, the diameter of the boss 76 can also be set to a small size, and machining is made easy.

The term "housing 42*h*" refers to a case-shaped member that houses the rotor or stator (not shown) of the electric motor 42 and defines the external shape of the motor 42, as described above.

Continuing the description of FIGS. 2 and 3, one end of the throttle shaft 54 is passed through the inside of the unit case 60 and made to protrude outward from the unit case 60. A manual operating lever 80 is also attached to the portion of the throttle shaft 54 that protrudes out of the unit case 60 (indicated by 541 in the figures).

A manually operable idle speed adjuster 82 for adjusting the idle engine speed is provided, to be operable by the operator, in the vicinity of the manual operating lever 80 on the external periphery of the unit case 60. The idle speed adjuster 82 is mounted on the external peripheral surface of the unit case 60 and is made up of a female screw component 84 threaded as a female screw, and a bolt 86 fitted into the aforementioned female screw.

As shown in FIG. 3, a throttle return spring 90 (helical torsion spring) is disposed inside of the unit case 60 around the throttle shaft 54. One end of the throttle return spring 90 is connected to the fourth gear 72 attached to the throttle shaft 54, and the other end is connected to a hook pin 92 protruding towards the inside of the unit case 60. Also, the coil direction of the throttle return spring 90 is set so that the throttle shaft 54 is rotated in the direction of closing the throttle valve 52.

The position (angle) of rotation of the throttle shaft 54 urged by the throttle return spring 90 in the direction of closing the throttle valve 52 is maintained by the manual operating lever 80 coming in contact with the leading end of the aforementioned bolt 86. In other words, the throttle return spring 90 is disposed around the throttle shaft 54 to urge the throttle shaft 54 to a position in which the lever 80 is brought into contact with the idle speed adjuster 82, such that the idle speed of the engine 10 can be adjusted by changing the position of the lever 80. The opening of the throttle valve 52 at this time constitutes the throttle opening when the engine 10 is in idle operation. As a result, by turning the bolt 86 and changing the position of the leading end thereof, the throttle opening during idle operation can be changed to adjust the idle speed of the engine 10.

Since a configuration is adopted herein whereby the fuel supply to the engine 10 is performed by the carburetor assembly 56 as described above, the throttle must be opened fully or almost fully when the engine is started. Accordingly, the ECU 50 is set so as to actuate the electric motor 42 such that the throttle valve 52 returns to the fully open position after the engine 10 is stopped, but drawbacks may occur whereby it becomes difficult to start the engine again if the throttle valve 52 is held nearly closed as a result of an operating error or the like when the engine 10 is stopped.

Figure 4:
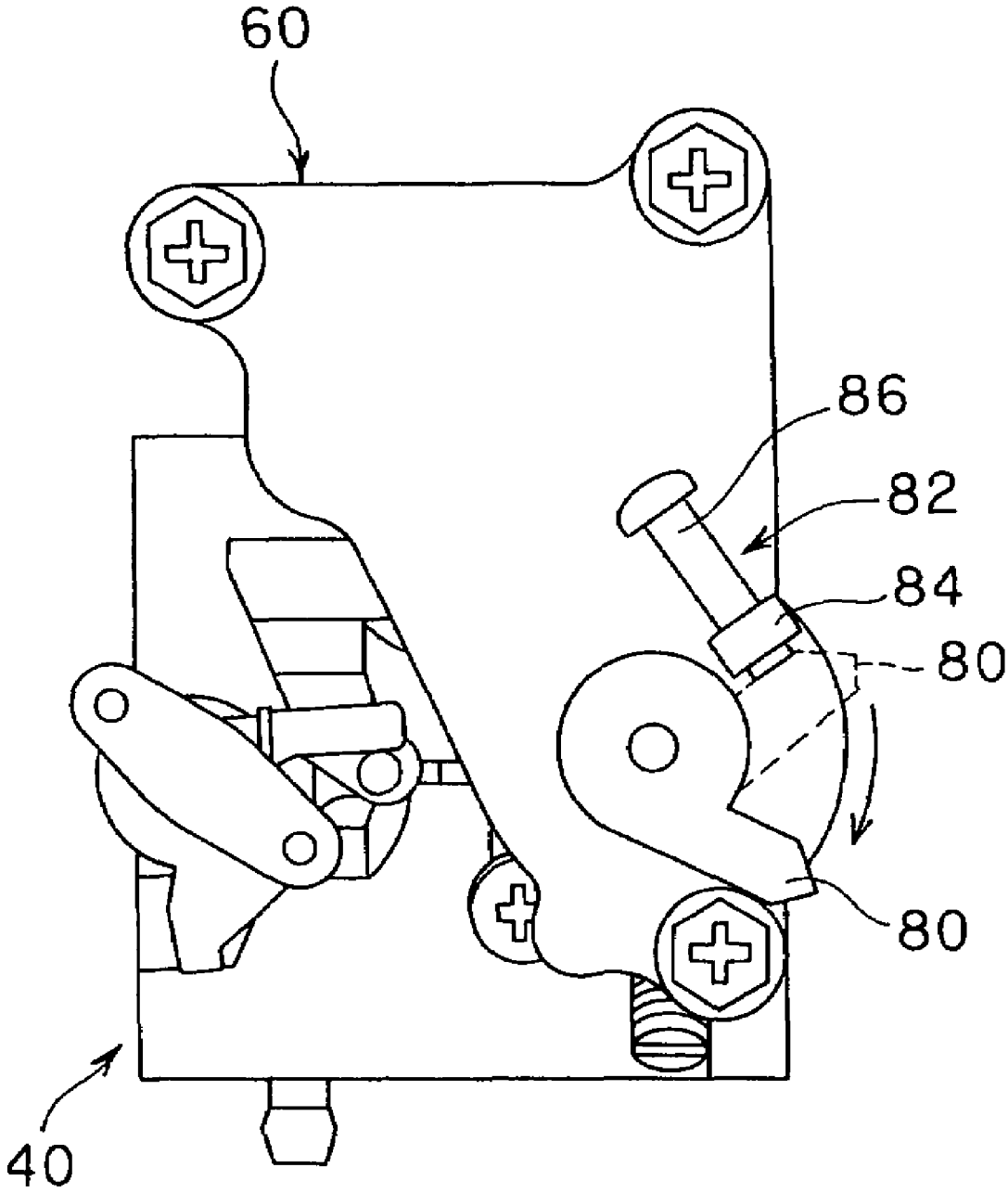
FIG. 4 is a plan view also showing the throttle body of the throttle device illustrated in FIG. 1.

However, a configuration is adopted in the present embodiment whereby one end of the throttle shaft 54 is caused to protrude from the unit case 60, and a manual operating lever 80 is attached to the protruding portion of the throttle shaft 54, so the engine 10 can easily be started again even when the throttle valve 52 is held nearly closed when the engine is stopped, because the throttle valve 52 can be opened by operating (turning) the manual operating lever 80 as shown in FIG. 4.

Because a configuration is also adopted whereby the idle speed adjuster 82 is provided whereby the position (rotational position) of the manual operating lever 80 is adjusted to adjust the idle speed of the engine 10, it becomes possible to adjust the opening of the throttle valve during engine starting and to adjust the idle engine speed using a single lever, thus enabling a compact structure to be obtained.

The throttle device for a multipurpose engine according to a second embodiment of the present invention will next be described.

Figure 5:
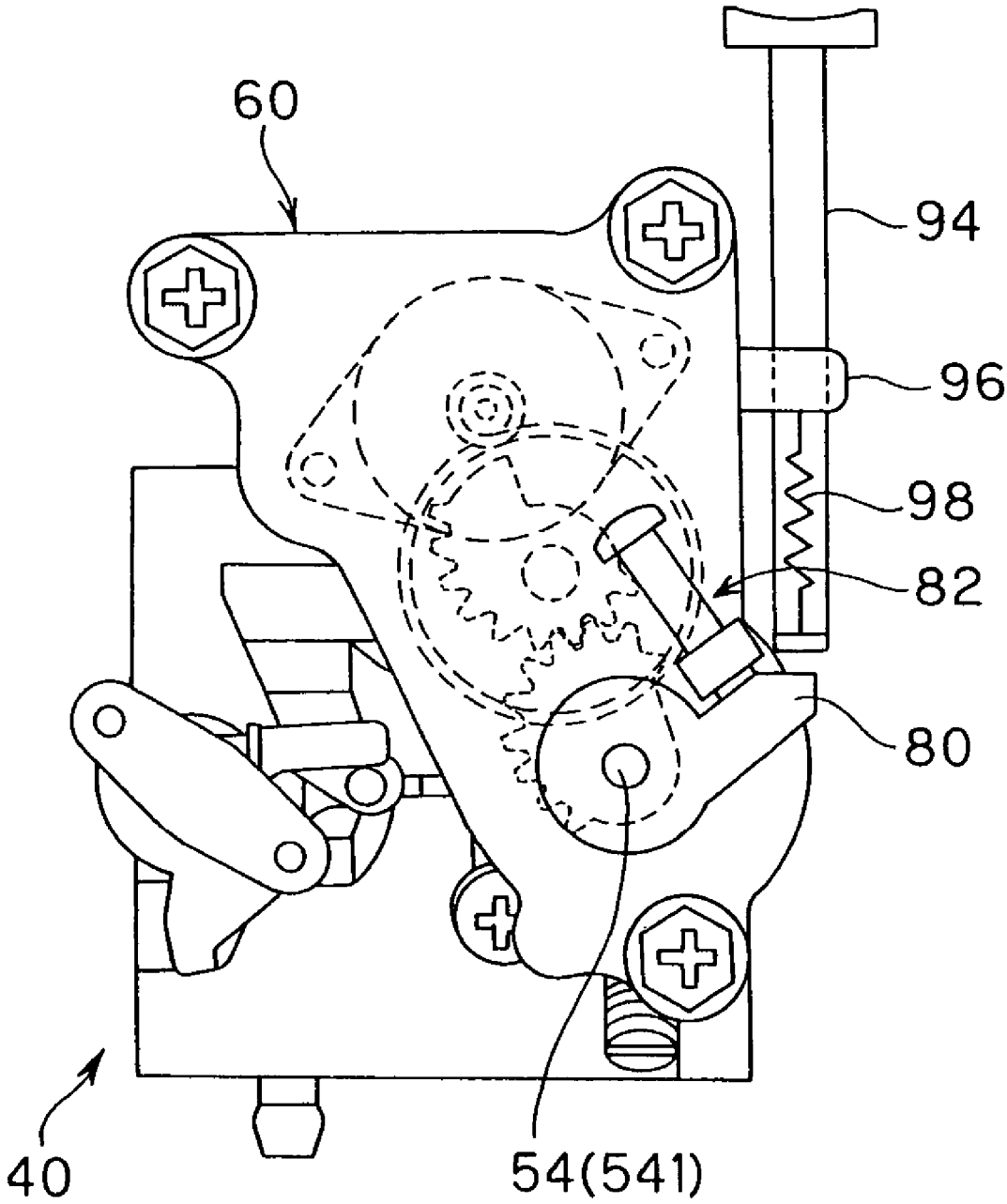
FIG. 5 is a plan view showing a throttle body of a throttle device for a multipurpose engine according to a second embodiment of the present invention.

FIG. 5 is a plan view showing the throttle body of the throttle device for a multipurpose engine according to the second embodiment.

The description hereinafter focuses on the differences between the present embodiment and the first embodiment, being that a configuration is adopted in the present embodiment whereby a manually operable pushrod 94 is provided, to be operable by the operator, for opening the throttle valve 52 when the manual operating lever 80 is pushed.

The pushrod 94 is held in a rectilinearly movable manner by a retainer 96 mounted on the external peripheral surface of the unit case 60. The retainer 96 is also connected to the pushrod 94 near the leading end thereof by a pushrod return spring 98 (tension coil spring).

The pushrod 94 is disposed so that the leading end thereof is positioned near the rotational position of the manual operating lever 80 by the urging force of the pushrod return spring 98 when not in operation during idling.

Figure 6:
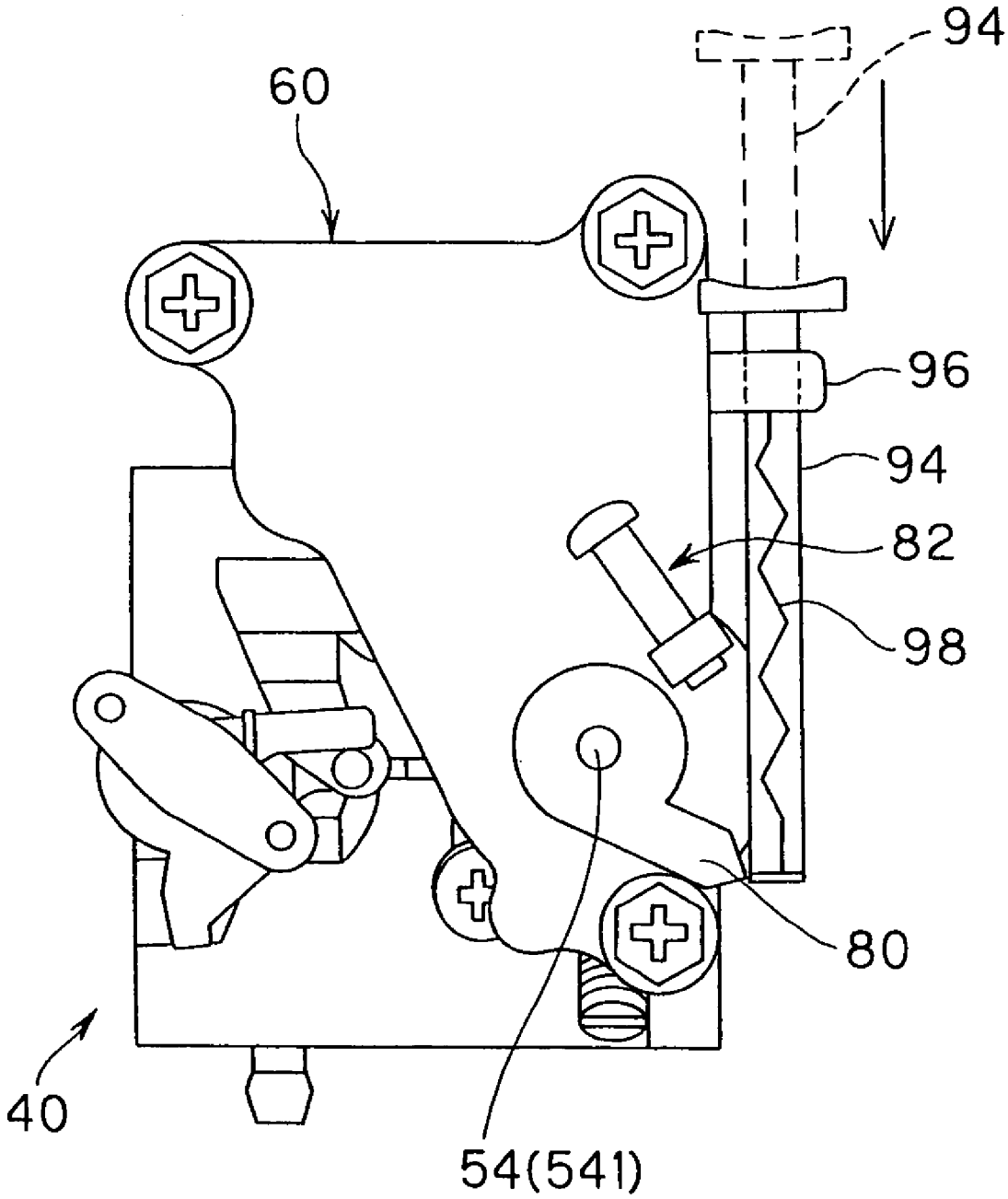
FIG. 6 is a plan view showing a throttle body of the throttle device illustrated in FIG. 5.

When the operator pushes the pushrod 94 against the urging force of the pushrod return spring 98, the manual operating lever 80 is pushed by the pushrod 94 and the throttle shaft 54 is rotated. Consequently, it is possible to open the throttle valve 52 by operating (pushing) the pushrod 94 as shown in FIG. 6, even when the throttle valve 52 is retained in a nearly closed position when the engine is stopped. By providing the pushrod 94, the operating point can be brought closer to the operator than in the first embodiment, and operation is carried out in a linear movement, so operability can be enhanced when opening the throttle valve 52, and restarting of the engine 10 can be performed much more easily.

Other aspects of this configuration are the same as in the previous embodiment, so description thereof is omitted.

As stated above, the first embodiment is thus configured to have a throttle device for a multipurpose internal combustion engine 10, comprising: a throttle valve 52 disposed at an air intake passage 22 of the engine; a throttle shaft 54 connected to the throttle valve; an electric motor 42 housed in a housing 42*h* and connected to the throttle shaft to move the throttle valve, the electric motor 42 having an output shaft 42*o* whose ends protrude from the housing; a power transmitting mechanism 58 connected to one end 42*o*1 of the output shaft 42*o* of the electric motor 42 in such a manner that other end 42*o*2 of the output shaft of the electric motor is received by a member formed in a fixing component (unit case 60) of the electric motor; and a controller (ECU 50)

controlling operation of the electric motor to regulate an amount of air passing through the air intake passage 22.

In the device, the member is a hollowed boss 76 formed at the fixing component of the electric motor 42, the fixing component is a case (unit case 60) that accommodates at least the throttle valve 52 and the power transmitting mechanism 58, and the throttle valve 52 is housed in a throttle body 40 that is accommodated in the case.

Thus, a configuration is adopted whereby both ends of the output shaft 42*o* are caused to protrude from the housing 42*h* of the electric motor 42, one end 42*o*1 is connected to the throttle shaft 54 via the power transmitting mechanism 58 and the other end 42*o*2 is inserted into the hollow boss 76 formed in the fixing component (unit case 60) of the electric motor, thereby making it possible to position the aforementioned electric motor 42 with respect to the aforementioned fixing component, so even when unevenness arises in the center of gravity of the output shaft 42*o* and the housing 42*h*, for example, the output shaft 42*o* can be accurately placed in the desired position because the positioning of the electric motor 42 is determined by the output shaft rather than by the housing 42*h*. With this, no fluctuation occurs in the positional relation of the output shaft 42*o* to the throttle shaft 54, and it is therefore possible to prevent friction from being generated in the power transmitting mechanism 58 that connects these components.

A secondary effect can also be obtained whereby the onboard electric motor 42 can be made smaller than conventionally, because the drive speed of the electric motor 42 can be increased and loss of transmission torque reduced by virtue of the ability to prevent friction from developing in the power transmission mechanism 58. Furthermore, since the output shaft 42*o* of the electric motor 42 is usually of a smaller diameter than the housing 42*h* and also the positioning extension formed by a conventional technique, effects are obtained whereby the diameter of the boss 76 can also be set to a small size and machining is made easy.

The first embodiment is also configured to have a throttle device for a multipurpose internal combustion engine 10, comprising: a throttle valve 52 housed in a throttle body 40 and disposed at an air intake passage 22 of the engine; a throttle shaft 54 connected to the throttle valve; an electric motor 42 connected to the throttle shaft to move the throttle valve; a case (unit case) 60 connected to the throttle body and accommodating at least the throttle shaft 54, more specifically both the throttle shaft 54 and the electric motor 42, in such a manner that one end of the throttle shaft 54 protrudes from the case 60; a lever (manual operating lever) 80 attached to the one end of the throttle shaft 54 to be operable by an operator; and a controller (ECU 50) controlling operation of the electric motor 42 to regulate an amount of air passing through the air intake passage.

Thus, a configuration is adopted whereby the unit case 60 is provided to the throttle body 40 for housing the throttle shaft 54 and the electric motor 42 that turns the throttle shaft 54, one end of the aforementioned throttle shaft 54 is caused to protrude from the aforementioned unit case 60, and the manual operating lever 80 is attached to this protruding portion, so restarting of the engine 10 can easily be performed even if the throttle valve 52 is retained in a nearly closed position when the engine is stopped, because the throttle valve 52 can be opened by operating the manual operating lever 80.

The device further includes: an idle speed adjuster 82 attached to the case to be operable by the operator in such a manner that a position of the lever 80 can be changed to adjust an idle speed of the engine 10. Specifically, the device further includes: a spring (throttle return spring) 90 disposed around the throttle shaft 54 to urge the throttle shaft 54 to a position in which the lever 80 is brought into contact with the idle speed adjuster 82, such that the idle speed of the engine can be adjusted by changing the position of the lever.

A configuration is thus adopted whereby a manually operable idle speed adjuster is provided whereby the position of the manual operating lever 80 is adjusted to adjust the idle speed of the multipurpose engine 10, so it becomes possible to adjust the opening of the throttle valve 52 during engine starting and to adjust the idle speed using a single lever, thus enabling a compact structure to be obtained.

The second embodiment is configured to further includes: a rod (pushrod) 94 attached to the case 60 to be operable by the operator in such a manner that the lever 80 is moved to open the throttle valve 52.

A configuration is thus adopted whereby the manually operable pushrod 94 is provided for opening the aforementioned throttle valve 52 when the manual operating lever 80 is pushed, so operability can be enhanced when opening the throttle valve 52, and restarting of the engine 10 can be performed much more easily.

It should be noted in the above that although a stepping motor is used as the electric motor, it is alternatively possible to use a DC motor or a rotary solenoid for the same purpose Japanese Patent Application Nos. 2003-183169 and 2003-183170, both filed on Jun. 26, 2003, are incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A throttle device for a multipurpose internal combustion engine, comprising:

a throttle valve disposed at an air intake passage of the engine;

a throttle shaft connected to the throttle valve;

an electric motor housed in a housing and connected to the throttle shaft to move the throttle valve, the electric motor having an output shaft whose ends protrude from the housing;

a power transmitting mechanism connected to one end of the output shaft of the electric motor in such a manner that the other end of the output shaft of the electric motor is directly received by a member formed in a fixing component of the electric motor; and a controller controlling operation of the electric motor to regulate an amount of air passing through the air intake passage.

2. The device according to claim 1, wherein the member is a hollowed boss formed at the fixing component of the electric motor.

3. The device according to claim 2, wherein the fixing component is a case that accommodates at least the throttle valve and the power transmitting mechanism.

4. The device according to claim 3, wherein the throttle valve is housed in a throttle body that is accommodated in the case.

5. A throttle device for a multipurpose internal combustion engine, comprising:

a throttle valve housed in a throttle body and disposed at an air intake passage of the engine;

a throttle shaft connected to the throttle valve;

an electric motor connected to the throttle shaft to move the throttle valve via a power transmitting mechanism;

a case connected to the throttle body and accommodating at least the throttle shaft, the electric motor and the power transmitting mechanism in such a manner that one end of the throttle shaft protrudes from the case;

a lever attached to the one end of the throttle shaft to be operable by an operator;

a controller controlling operation of the electric motor to regulate an amount of air passing through the air intake passage; and an idle speed adjuster attached to the case to be operable by the operator in such a manner that a position of the lever can be changed to adjust an idle speed of the engine.

6. The device according to claim 5, further including:

a spring disposed around the throttle shaft to urge the throttle shaft to a position in which the lever is brought into contact with the idle speed adjuster, such that the idle speed of the engine can be adjusted by changing the position of the lever.

7. A throttle device for a multipurpose internal combustion engine, comprising:

a throttle valve housed in a throttle body and disposed at an air intake passage of the engine;

a throttle shaft connected to the throttle valve;

an electric motor connected to the throttle shaft to move the throttle valve via a power transmitting mechanism;

a case connected to the throttle body and accommodating at least the throttle shaft, the electric motor and the power transmitting mechanism in such a manner that one end of the throttle shaft protrudes from the case;

a lever attached to the one end of the throttle shaft to be operable by an operator; a controller controlling operation of the electric motor to regulate an amount of air passing through the air intake passage; and a rod attached to the case to be operable by the operator in such a manner that the lever is moved to open the throttle valve.

* * * * *